US010167859B2

(12) United States Patent
Deel

(10) Patent No.: US 10,167,859 B2
(45) Date of Patent: Jan. 1, 2019

(54) HYDRAULIC VALVE COVER ASSEMBLY

(71) Applicant: NABORS INDUSTRIES, INC., Houston, TX (US)

(72) Inventor: Steven K. Deel, Cypress, TX (US)

(73) Assignee: Nabors Industries, Inc., Houston, TX (US)

( * ) Notice: Subject to any disclaimer, the term of this patent is extended or adjusted under 35 U.S.C. 154(b) by 506 days.

(21) Appl. No.: 14/742,038

(22) Filed: Jun. 17, 2015

(65) Prior Publication Data

US 2016/0369909 A1 Dec. 22, 2016

(51) Int. Cl.

| | |
|---|---|
| ***F04B 39/00*** | (2006.01) |
| ***F04B 39/10*** | (2006.01) |
| ***F04B 53/22*** | (2006.01) |
| ***F04B 1/12*** | (2006.01) |
| ***F04B 39/14*** | (2006.01) |
| ***E21B 21/10*** | (2006.01) |

(52) U.S. Cl.

CPC ..... *F04B 39/10* (2013.01); *E21B 21/10* (2013.01); *F04B 1/122* (2013.01); *F04B 39/14* (2013.01); *F04B 53/22* (2013.01)

(58) Field of Classification Search

CPC ..... F04B 1/122; F04B 39/10; F04B 39/14; F04B 53/22; F16K 43/00; F16K 27/12

USPC ..... 137/454.4, 454.6; 251/366–367

See application file for complete search history.

(56) References Cited

U.S. PATENT DOCUMENTS 2,304,991 A * 12/1942 Foster ..... F04B 53/1027 137/454.4
2,809,059 A * 10/1957 Hillis ..... F16K 41/02 137/315.27
3,435,777 A * 4/1969 Schaaf ..... F16B 31/04 292/256.71
4,394,872 A * 7/1983 Schobl ..... F16K 41/02 137/315.28
4,516,477 A 5/1985 Lewis et al.
4,601,304 A * 7/1986 Schobl ..... F16K 41/02 137/315.27

(Continued)

OTHER PUBLICATIONS

International Search Report and Written Opinion dated Sep. 12, 2016 issued in International Application No. PCT/US2016/037263; 10 pp.

(Continued)

*Primary Examiner* — Devon Kramer
*Assistant Examiner* — Christopher Bobish
(74) *Attorney, Agent, or Firm* — Haynes and Boone, LLP

(57) ABSTRACT

The systems, devices, and methods described herein describe a valve cover assembly that enables the easy removal and insertion of a screw gland into a threaded ring. The valve cover assembly includes an outside housing that provides an offset between a fluid end module and a top end of the valve cover assembly. A spring is positioned between the top end and the threaded ring and biased to provide a downward force on the threaded ring. The screw gland applies a reaction force against a valve plug. A piston is positioned at a base of the threaded ring in contact with the fluid end module. When actuated, the piston overcomes the downward force and lifts the threaded ring from the fluid end module. This reduces the force on the plug and allows a user to remove the screw gland by hand (and install as well) and without additional machinery required.

18 Claims, 13 Drawing Sheets

(56) References Cited

U.S. PATENT DOCUMENTS

| | | | | |
|---|---|---|---|---|
| 6,209,445 | B1 * | 4/2001 | Roberts, Jr. | F04B 53/168 92/128 |
| 7,290,560 | B2 * | 11/2007 | Orr | F04B 53/007 137/454.2 |
| 7,770,509 | B2 * | 8/2010 | Kennedy | F04B 47/08 417/454 |
| 7,866,346 | B1 * | 1/2011 | Walters | E21B 21/01 138/89 |
| 8,365,754 | B2 * | 2/2013 | Riley | F04B 39/121 137/15.17 |
| 8,393,260 | B2 * | 3/2013 | Kennedy | F04B 47/08 417/454 |
| 8,763,496 | B2 * | 7/2014 | Case | B25B 21/005 29/890.124 |
| 2010/0054974 | A1 | 3/2010 | Riley et al. | |
| 2010/0278661 | A1 | 11/2010 | Clemens | |
| 2010/0319529 | A1 | 12/2010 | Kennedy et al. | |
| 2011/0173814 | A1 | 7/2011 | Patel | |
| 2017/0089334 | A1 * | 3/2017 | Jahnke | F04B 53/10 |

OTHER PUBLICATIONS

P-Quip Ltd., Instructions for the Safe Use of P-Quip Valve Cover Retention Systems—Pt. No. 12000000, Revision date: Dec. 19, 2007, 6 pages.

Canadian Patent Office, "Examination Report" for Application No. 2,978,776, dated Jun. 12, 2018, 3 pages.

* cited by examiner

HYDRAULIC VALVE COVER ASSEMBLY

TECHNICAL FIELD

The present disclosure is directed to systems, devices, and methods for valve cover assembly and service. More specifically, the present disclosure is directed to systems, devices, and methods for safely installing and removing screw glands of valve cover assemblies and installing or pulling valve seats in a hydraulic reciprocating pump used in oil and gas drilling environments.

BACKGROUND OF THE DISCLOSURE

Multi-cylinder reciprocating pumps, often referred to as mud pumps, are utilized during the drilling process to deliver high pressure drilling fluid "mud" to the well bore. These pumps are composed of two primary sections, the power end and the fluid end. The fluid end consists of a series of forged steel blocks or "modules" that have been machined to create a housing for the valve service that includes a valve, a seat, and a spring. The fluid end modules have an opening in which the valve service is installed. The opening is closed with a valve cover that retains the valve service as well as contain the high pressure drilling fluid during operation. Valve cover assemblies typically consist of a seal retainer (such as a plug), a threaded ring, and a screw gland. The threaded ring is fastened to the fluid end module by a series of studs. Assembly of the valve cover involves installing the plug in the fluid end module and inserting the screw gland into the threaded ring until the bottom surface of the screw gland contacts the plug.

To secure the screw gland in place, a steel bar is then inserted into the screw gland and a sledge hammer is used to further tighten the gland, compressing the seal for a fluid tight arrangement. This method has a number of shortcomings, including safety related to the use of sledge hammers to operate. As the operator continually hits the steel bar to loosen or tighten the screw gland, pieces of metal can be removed from the bar, which poses hazards. Additional maintenance of the system is also required to ensure the screw gland remains tight during operation of the pumps, due to changes in operating pressure, temperatures, etc.

The present disclosure is directed to systems, devices, and methods that overcome one or more of the shortcomings of the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
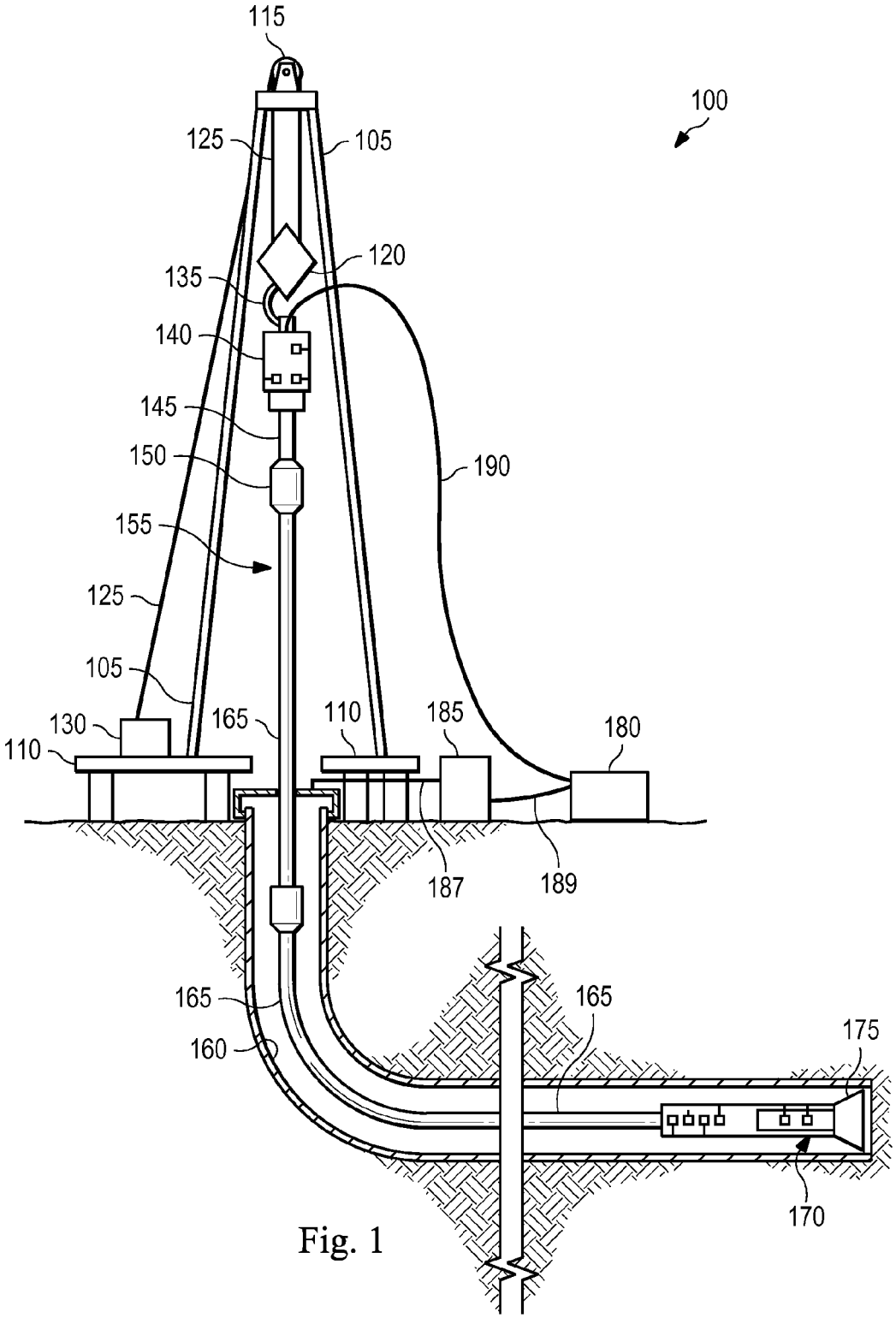
FIG. 1 is a schematic of an exemplary drilling rig according to one or more aspects of the present disclosure.

It is to be understood that the following disclosure provides many different embodiments, or examples, for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The systems, devices, and methods described herein describe a drilling rig apparatus that includes a mud pump having valve covers for the fluid end that address limitations of current solutions. For example, embodiments of the present disclosure take into consideration the desirability to increase safety when servicing the mud pump as well as simplifying the valve cover assembly to reduce the number of components. Fewer components may result in a lower number of potential failure points as well as a reduction in manufacturing costs.

Embodiments of the present disclosure utilize a threaded ring in which an annular piston has been incorporated into the lower face. Large diameter disc springs may be used to provide a positive downward biasing force on a valve plug, which causes a fluid tight seal at the fluid end module. When pressure is applied to the piston with a portable hydraulic pump, the piston is extended which, in turn, lifts the threaded ring/screw gland and compresses the disc springs. Lifting of the screw gland removes the downward biasing force applied to the valve plug, thereby allowing the screw gland to be more easily removed, such as by hand by the operator.

Further, embodiments of the present disclosure may be used to remove valve seats in lieu of an external valve seat puller. The annular piston, for example, may be used to create vertical movement in the threaded ring and screw gland. A puller head and rod may be installed in the fluid end. With no pressure on the valve cover assembly, a plate is installed on top of the screw gland along with a heavy hex head nut to secure the plate. As pressure is applied the piston will extend, lifting the screw gland and imparting an upward force on the puller rod, puller head, and valve seat to dislodge the seat from the fluid end module.

Further embodiments of the present disclosure may be used to install valve seats during servicing while the piston is actuated. To do so, the user may install a new seat in the fluid end module, for example by hand (e.g., while the screw gland, valve plug, and valve service are removed). A driver tool may then be installed on top of the valve seat, followed by screw gland installation into the threaded ring. With the threaded ring still raised due to the actuated piston, the screw gland is tightened (for example by hand) on top of the driver tool. Releasing the hydraulic pressure applied to the piston allows the spring pack to force the driver tool down, pressing the seat into the tapered module bore.

FIG. 1 is a schematic of a side view of an exemplary drilling rig 100 according to one or more aspects of the present disclosure. In some examples, the drilling rig 100 may form a part of a land-based, mobile drilling rig. However, one or more aspects of the present disclosure are applicable or readily adaptable to any type of drilling rig with supporting drilling elements, for example, the rig may include any of jack-up rigs, semisubmersibles, drill ships, coil tubing rigs, well service rigs adapted for drilling and/or re-entry operations, and casing drilling rigs, among others within the scope of the present disclosure.

The drilling rig 100 includes a mast 105 supporting lifting gear above a rig floor 110. The lifting gear may include a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel out and reel in the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill." It should be understood that other techniques for arranging a rig may not require a drilling line, and these are included in the scope of this disclosure.

The drill string 155 includes interconnected sections of drill pipe 165, a bottom hole assembly (BHA) 170, and a drill bit 175. The bottom hole assembly 170 may include stabilizers, drill collars, and/or measurement-while-drilling (MWD) or wireline conveyed instruments, among other components. The drill bit 175 is connected to the bottom of the BHA 170 or is otherwise attached to the drill string 155. In the exemplary embodiment depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

A mud pump system 180 receives the drilling fluid, or mud, from a mud tank assembly 185 and delivers the mud to the drill string 155 through a hose or other conduit 190, which may be fluidically and/or actually connected to the top drive 140. In an embodiment, the mud may have a density of at least 9 pounds per gallon. As more mud is pushed through the drill string 155, the mud flows through the drill bit 175 and fills the annulus that is formed between the drill string 155 and the inside of the well bore 160, and is pushed to the surface. At the surface the mud tank assembly 185 recovers the mud from the annulus via a conduit 187 and separates out the cuttings. The mud tank assembly 185 may include a boiler, a mud mixer, a mud elevator, a mud mixer, and mud storage tanks. After cleaning the mud, the mud is transferred from the mud tank assembly 185 to the mud pump system 180 via a conduit 189 or plurality of conduits 189. When the circulation of the mud is no longer needed, the mud pump system 180 may be removed from the drill site and transferred to another drill site.

Figure 2:
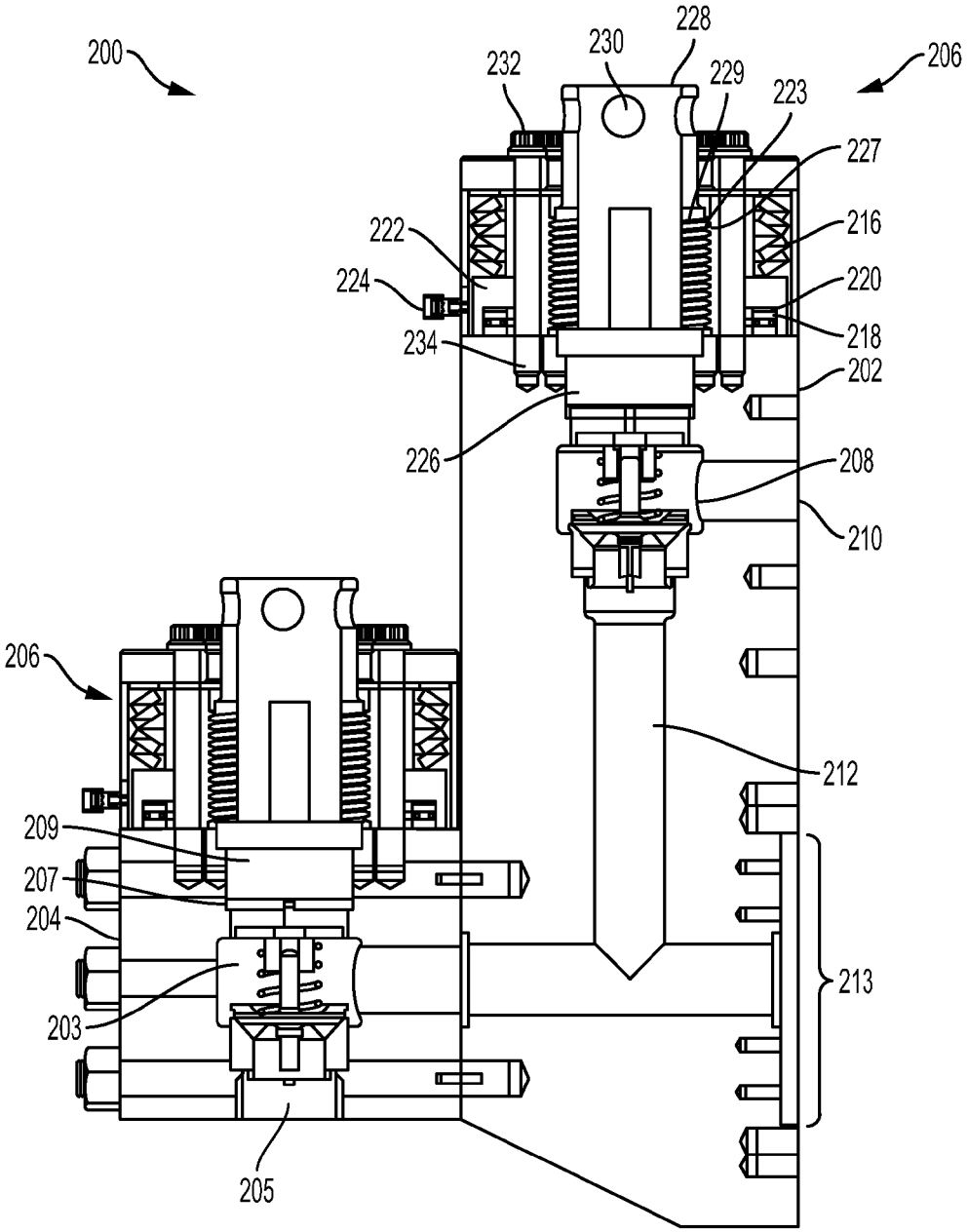
FIG. 2 is a schematic of an exemplary fluid end with valve cover assembly of a mud pump according to one or more aspects of the present disclosure.

The mud pump system 180 includes a power end and a fluid end. Embodiments of the present disclosure provide for an improved valve cover assembly for the fluid end. FIG. 2 is a schematic of an exemplary fluid end 200 with valve cover assembly 206 of a mud pump, such as mud pump 180 of FIG. 1, according to one or more aspects of the present disclosure. The fluid end 200 includes a fluid discharge module 202, a fluid intake module 204, and the valve cover assemblies 206 (e.g., one for each of the fluid discharge module 202 and the fluid intake module 204).

The fluid discharge module 202 may include a valve service 208, a fluid outlet bore 210, a fluid passage bore 212, and a motor end interface 213. The valve service 208 may include, for example, a valve, a valve seat, and a spring. The valve of valve service 208 may, in operation, open in response to an increase in fluid pressure within the fluid passage bore 212 as a result of compression movement by the motor end (at the motor end interface 213), allowing the fluid within the fluid passage bore 212 (such as mud) to pass through the valve, into the fluid outlet bore 210, and on to the conduit 190 of FIG. 1. The valve of valve service 208 may, in operation, close in response to a decrease in fluid pressure within the fluid passage bore 212 as a result of an expansion movement by the motor end at the motor end interface 213 (e.g., an axial motion of a piston in fluid communication at the motor end interface 213) in a direction away from the fluid end 200 that expands the volume of the area in the fluid passage bore 212. The fluid discharge module 202 also includes a bore opening 225 in which the valve service 208 is installed and in which the valve plug 226 of a valve cover assembly 206 is placed so that, during operation (the compression and expansion) the high pressure drilling fluid is contained within the fluid end 200.

The fluid intake module 204 may include a valve service 203 (similarly containing a valve, valve seat, and spring as described with respect to valve service 208), a fluid intake bore 205, a bore opening 207, and an extension of the fluid passage bore 212 associated with the fluid discharge module 202. The fluid intake module 204 may be coupled to a fluid passageway, such as conduit 189, that is coupled to mud tank assembly 185 of FIG. 1 that operates as a fluid source to the fluid end 200. The valve of valve service 203 may, in operation, close in response to an increase in fluid pressure within the fluid passage bore 212 as a result of the compression movement at the motor end (that causes the valve of valve service 208 to open in the fluid discharge module 202), preventing fluid in the fluid passage bore 212 from being forced back into the conduit 189 via the fluid intake bore 205. Further, the valve of valve service 203 may, in operation, open in response to a decrease in fluid pressure within the fluid passage bore 212 as a result of the expansion movement by the motor end at the motor end interface 213, allowing new fluid to enter the fluid passage bore 212. The bore opening 225 in which the valve service 203 is installed and in which the valve plug 209 of a valve cover assembly 206 is placed so that, during operation (the compression and expansion) the high pressure drilling fluid is contained within the fluid end 200.

A valve cover assembly 206 is coupled to the fluid end 200 at each of the fluid discharge module 202 and the fluid intake module 204. For purposes of simplicity, the following discussion will focus on the valve cover assembly 206 coupled to a top end of the fluid discharge module 202, though it will be recognized that the discussion may be similarly applicable to the valve cover assembly coupled to a top end of the fluid intake module 204. In describing the valve cover assembly 206, reference will be made to FIGS. 3A, 3B, 3C, and 3D, which illustrate a perspective view of a cross section of the assembly, an exploded perspective view of the assembly, a top view of the assembly, and a bottom view of the assembly, respectively.

The valve cover assembly 206 may be attached to the fluid discharge module 202 by one or more studs 232 into corresponding holes 234 in the fluid discharge module 202 (FIG. 2). In an embodiment, the one or more studs 232 are stud-and-nut configurations, while in other embodiments the one or more studs 232 may be capscrews (e.g., 12-point capscrews). The valve cover assembly 206 may be designed with the one or more studs 232 so as to be compatible with existing fluid end module configurations. The valve cover assembly 206 may include an outside housing 214, one or more springs 216, a piston 218 within a recess 220, an inner area 221, a threaded ring 222, a top end 223, a port 224, the valve plug 226, and a screw gland 228.

Figure 3A:
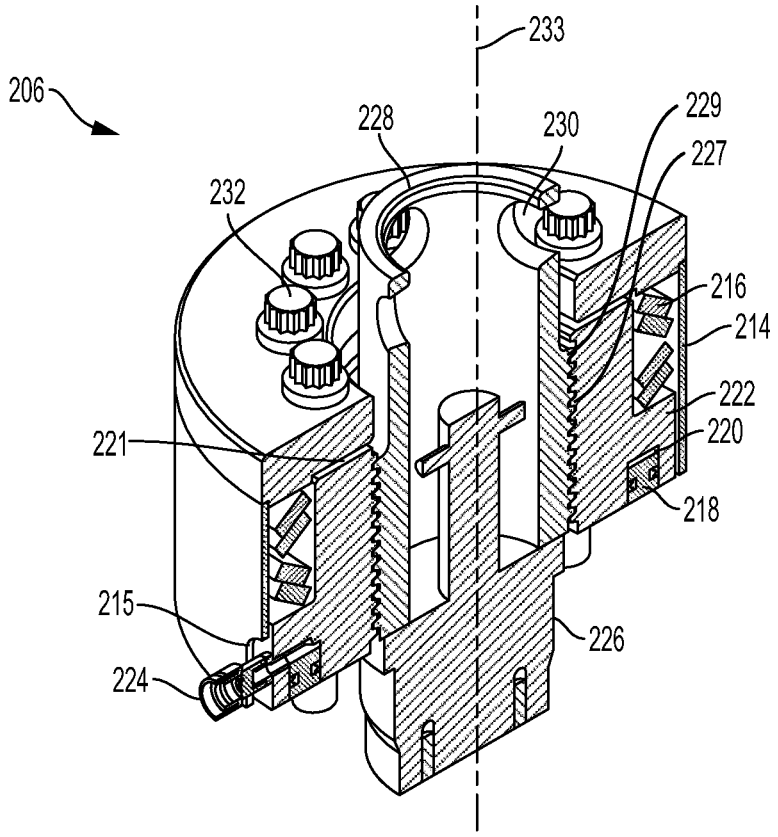
FIG. 3A is a schematic of a perspective cross-sectional view of an exemplary valve cover assembly according to one or more aspects of the present disclosure.
Figure 3B:
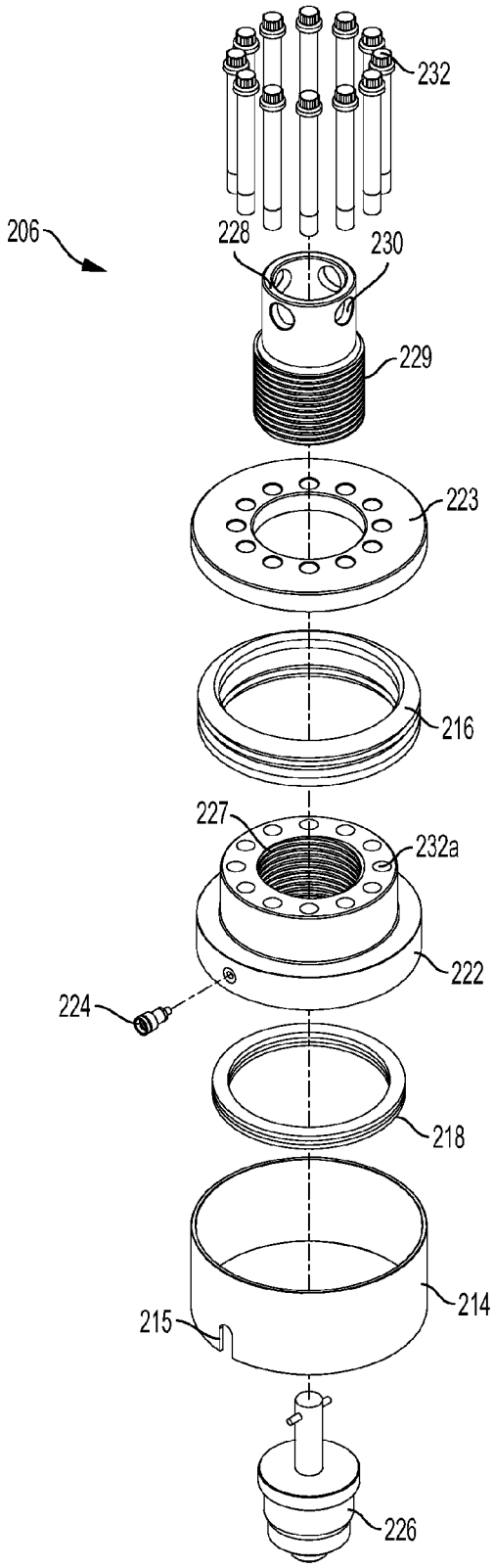
FIG. 3B is a schematic of a perspective exploded view of an exemplary valve cover assembly according to one or more aspects of the present disclosure.

The outside housing 214 circumferentially surrounds the other internal elements of the valve cover assembly 206 including the one or more springs 216, the piston 218, the inner area 221, the threaded ring 222, and the screw gland 228, as illustrated in FIGS. 3A and 3B. The outside housing 214 is designed to protect the interior elements of the valve cover assembly 206, including the one or more springs 216, the threaded ring 222, and the piston 218 within the recess 220. Further, the outside housing 214 is designed to provide an offset between the top end 223 and the top of the fluid discharge module 202 (as held in place by the one or more studs 232 installed into receiving holes in the main block of the fluid discharge module 202). This offset results from the outside housing 214 having a length along a vertical axis 233 of the valve cover assembly 206 that is larger than the length of the threaded ring 222 along the vertical axis 233. In an embodiment, the length of the threaded ring 222 along the vertical axis 233 may be a quarter of an inch less than the length of the outside housing 214 along the vertical axis 233. This offset allows the threaded ring 222 a certain amount of space in the inner area 221 in which to move as will be discussed in more detail below. Although the top end 223 is illustrated as a separate component than the outside housing 214 in FIGS. 3A and 3B, as will be recognized the top end 223 may alternatively be integrated with the outside housing 214.

The threaded ring 222 is shaped in the form of an annulus, with a base portion having a larger diameter than an upper portion. As illustrated in FIGS. 3A and 3B, the base portion of the threaded ring 222 has a diameter that extends to meet an interior wall of the outside housing 214. The outside diameter of the base portion of the threaded ring 222 is not solidly attached to the outside housing 214. Instead, there may be a small gap between the outside diameter of the base portion and the outside housing 214, such as a few millimeters as just one nonlimiting example. From the base portion, the threaded ring 222 extends in length along a vertical axis 233 of the valve cover assembly 206. The diameter of the threaded ring 222 narrows at a transition between the base portion and the upper portion of the threaded ring 222. In an embodiment, the base portion may occupy approximately a bottom third of the length of the threaded ring 222 along the vertical direction, while the upper portion may occupy approximately an upper two-thirds of the length. This is exemplary only—the respective lengths of the upper and base portions may vary from the exemplary values given.

The upper portion of the threaded ring 222 may be smaller in diameter than the base portion in order to provide space for the one or more springs 216, as can be seen in FIGS. 3A and 3B. As illustrated, the one or more springs 216 may be situated between the outside housing 214 and the outer radial extent of the upper portion of the threaded ring 222. This is illustrative only; as will be recognized, the upper portion of the threaded ring 222 may alternatively have the same diameter as the base portion and, instead, provide a recess to receive the one or more springs 216 somewhere along the radial extent of the threaded ring 222 between the hollow center of the annulus and the radial edge of the threaded ring. In either embodiment, the base portion of the threaded ring 222 may serve as a threaded ring interface of the threaded ring 222 for a bottom end of the one or more springs 216 in conjunction with a top end interface of the top end 223 for a top end of the one or more springs 216. As a result, the ends of the one or more springs 216 may press against the threaded ring interface and the top end interface to exert a net downward biasing force against the threaded ring 222.

The hollow center of the threaded ring 222 is designed to interface with the screw gland 228 and extends throughout the entire length of the vertical axis 233. The hollow center may include the threads 227 that are designed to threadably engage with threads 229 of the screw gland 228. The hollow center of the threaded ring 222 has a diameter that is larger than a diameter of the valve plug 226. As a result, the valve plug 226 and one or more elements of the valve service 208 may be inserted and removed through the hollow center while the valve cover assembly 206 is otherwise still in place with the screw gland 228 removed.

Figure 3C:
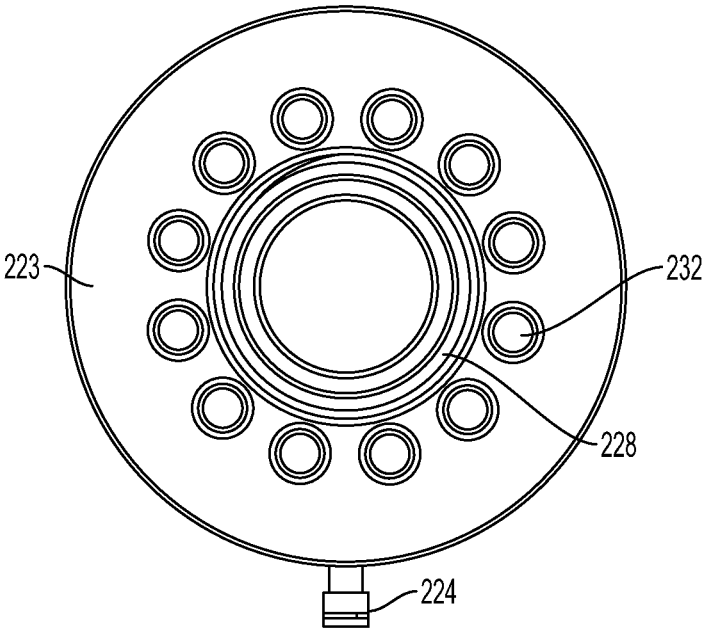
FIG. 3C is a schematic of a top view of an exemplary valve cover assembly according to one or more aspects of the present disclosure.
Figure 3D:
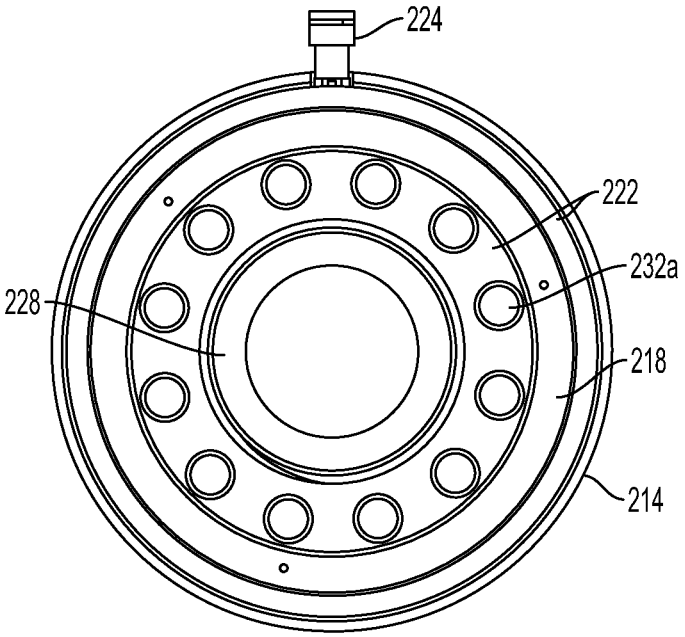
FIG. 3D is a schematic of a bottom view of an exemplary valve cover assembly according to one or more aspects of the present disclosure.

As illustrated in FIG. 3B, the threaded ring 222 includes holes 232*a* that are designed to receive the studs 232. In an embodiment, there may be twelve holes 232*a* designed to receive twelve respective studs 232. The number of holes and studs may be arbitrary, e.g. there may be fewer or more studs and holes without departing from the scope of the present disclosure. The holes 232*a* extend along the length of the vertical axis 233 through the threaded ring 222, so that a stud 232 installed through the top end 223 may reach through the threaded ring 222 inside the valve cover assembly 206 and anchor into a receiving hole in the fluid discharge module 202. This is illustrated, for example, in FIGS. 3C and 3D. In FIG. 3C, the top view illustrates the tops of the studs 232 being installed in through the top end 223 of the valve cover assembly 206. In FIG. 3D, it can be seen in the bottom view of the assembly that the holes 232*a* extend through the bottom of the threaded ring 222. The holes 232*a* may be appropriately sized in diameter so that the threaded ring 222 may still move vertically during operation with respect to the outside housing 214 and the top end 223 without undue friction or wear (e.g., the diameter of the holes 232 may be marginally larger than the diameter of the studs 232).

Although the threaded ring 222 is illustrated in FIGS. 3A and 3B as being solid throughout, this is exemplary for purposes of illustration only. As will be recognized, in some embodiments the threaded ring 222 may alternatively provide surfaces for the threaded ring interface for the one or more springs 216, a top end of the threaded ring 222 to stop travel of the threaded ring 222 against the top end 223, and at least some portions of the bottom end of the threaded ring 222 to rest against the top of the fluid discharge module 202 and house one or more pistons 218.

The one or more springs 216 illustrated in FIGS. 2, 3A, and 3B may be any type of spring suitable to provide sufficient downward biasing force so as to press and maintain the valve plug 226 in the bore opening 225 during operation when high pressures may continuously or intermittently be present that could exert an upward force against the screw gland 228 and/or threaded ring 222 of the valve cover assembly 206. In an embodiment, the one or more springs 216 may be multiple Belleville springs (otherwise referred to as Belleville washers) in a spring pack. Thus, the one or more springs 216 may be annular discs that have an outer diameter that is slightly less than the diameter of the outside housing 214 and a large hollow center whose diameter is slightly larger than the diameter of the upper portion of the threaded ring 222. The springs 216 may be stacked on each other. For example, as illustrated, multiple springs may be stacked in the same and/or different directions to achieve a desired amount of biasing force as well as a desired amount of hysteresis as will be recognized. The springs 216 may be composed of any of a variety of metals and plastics.

The springs 216 may have an equilibrium height that causes the springs 216, when placed on the threaded ring interface of the threaded ring 222, to extend on the vertical axis 233 of the valve cover assembly 206 to a point just beyond the upper end of the outside housing 214. As a result, when the top end 223 is placed on the valve cover assembly 206, heavy hex nuts associated with the studs 232 may be applied to compress the springs 216 to apply a downward biasing force against the threaded ring interface. The downward biasing force may be transferred from the threaded ring interface, through the threaded ring 222, to the screw gland 228 via the threads 227 and 229, so that the force may be applied against the valve plug 226 during operation of the mud pump. Although illustrated as multiple Belleville springs in a spring pack, as will be recognized, other types of springs may alternatively be used to provide a desired downward biasing force.

Returning to the threaded ring 222 as illustrated in FIGS. 3A, 3B, and 3D, the threaded ring 222 may further include a recess 220 designed to receive a piston 218. In the embodiment illustrated in FIG. 3D, the recess 220 and corresponding piston 218 are annular and substantially extend along the entire circumferential length of the threaded ring 222. In an alternative embodiment, the recess 220 may be multiple discrete recesses at different points around the circumferential length of the threaded ring 222 to house multiple discrete pistons 218, and may be fluidically coupled to each other to avoid requiring additional ports 224. Returning to the annular recess 220 and piston 218 embodiment, the piston 218 may be sized so that, at rest, the top of the piston 218 is proximate to, or in contact with, the back end of the recess 220. Alternatively, a gap may exist in the recess 220 even at rest and be filled with a small amount of fluid, such as hydraulic fluid. The recess 220 may be fluidically coupled to the port 224. The port 224 may be a quick disconnect (QD) fitting, to name an example, to allow a pump, such as a portable hydraulic pump, to attach and detach as desired. In an embodiment, the port 224 is mounted to the threaded ring 222 in a manner that prevents movement of the threaded ring 222 with respect to the port 224. In this embodiment, the outside housing 214 may include an opening 215 that is sufficiently wide to accommodate the diameter of the port 224 and tall enough to allow a desired range of motion for the threaded ring 222 (e.g., a quarter of an inch vertically away from the base of the valve cover assembly 206).

A hydraulic pump (not shown) may be attached to the port 224 and pump hydraulic fluid into the recess 220, thereby forcing the piston 218 to extend downward. The amount of fluid pumped into the recess 220 is sufficient to overcome the downward biasing force of the springs 216, thereby causing the threaded ring 222 with (or without) screw gland 228 to move vertically (upward along the vertical axis 233 of the valve cover assembly 206) away from the top of the fluid discharge module 202 and the valve plug 226. When the hydraulic pump removes the fluid from the recess 220, the downward biasing force again becomes the dominant force and pushes the threaded ring 222 back down toward the top of the fluid discharge module 202.

Thus, embodiments of the present disclosure illustrate a valve cover assembly 206 that provides a threaded ring 222 that may move relative to the fluid discharge module 202 and the outside housing 214/top end 223 of the valve cover assembly 206. This is illustrated in FIGS. 4A and 4B, which illustrate schematics of a cross-sectional view of an exemplary valve cover assembly in first and second positions according to one or more aspects of the present disclosure.

Figure 4A:
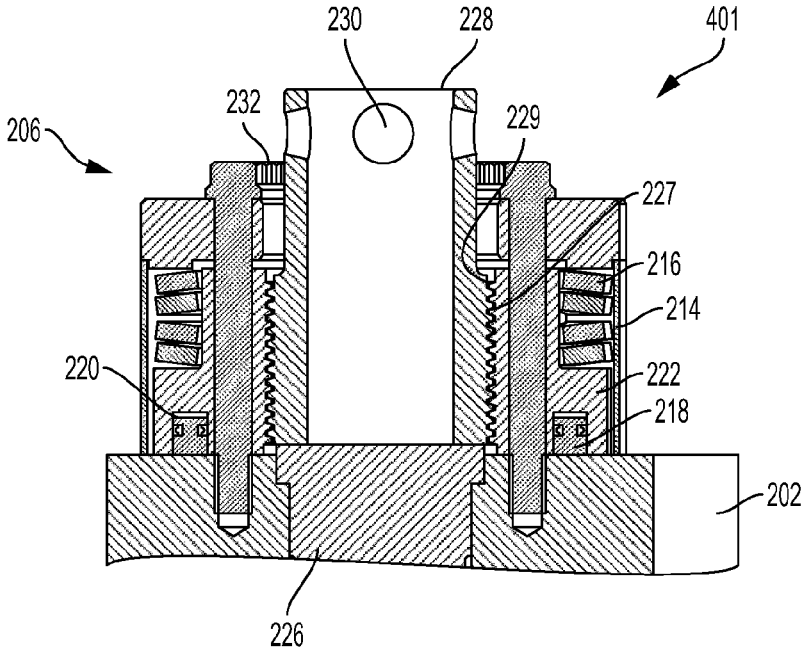
FIG. 4A is a schematic of a cross-sectional view of an exemplary valve cover assembly in a first position according to one or more aspects of the present disclosure.

In FIG. 4A, the threaded ring 222 of the valve cover assembly 206 is in a first position, which may be referred to as a nonactuated or pumping condition. In the first position, pressure from a hydraulic pump is not being applied into the recess 220 or, if a hydraulic pump is attached to the port 224, there is not enough pressure being applied so as to overcome the downward biasing force of the springs 216. In this configuration, the downward biasing force presses the threaded ring 222 downward against the top of the fluid discharge module 202 and, as a result, the threaded screw gland 228 against the valve plug 226, keeping the valve plug 226 in place. This large downward biasing force renders it difficult to remove the screw gland 228, however. According to embodiments of the present disclosure, this difficulty is overcome by actuating the piston 218 of the valve cover assembly 206 to vertically displace the threaded ring 222 and, in turn, the screw gland 228.

To accomplish this vertical displacement, a hydraulic pump attached to port 224 pumps fluid into the recess 220 to increase the pressure being applied against the piston 218. When pressure is applied against the piston 218, the piston 218 begins extending away from the threaded ring 222. Since the piston 218 is or becomes in contact with the top surface of the fluid discharge module 202, the expansion of the piston 218 from the recess 220 translates into an upward force against the threaded ring 222. At a point at which the pressure applied against the piston 218 and the resulting upward force exceeds the downward biasing force of the springs 216, the threaded ring 222 lifts up and compresses the springs 216.

Figure 4B:
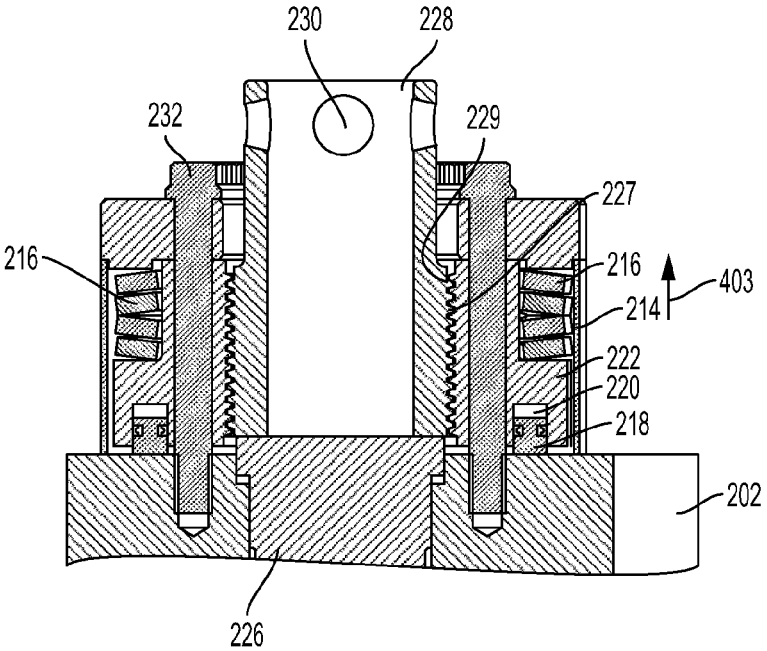
FIG. 4B is a schematic of a cross-sectional view of an exemplary valve cover assembly in a second position according to one or more aspects of the present disclosure.

This is illustrated in FIG. 4B, shown as a second position, which may be referred to as an actuated or service condition. In FIG. 4B, the pressure applied against the piston 218 results in the upward force 403 which is sufficient to cause the springs 216 to compress within the area 221. As illustrated, the vertical length of the valve cover assembly 206 is fixed and defined by the lengths of the outside housing 214 and the width of the top end 223, held in place by the studs 232. Thus, the springs 216 are compressed between the top end 223 and the threaded ring interface of the threaded ring 222. With the screw gland 228 lifted, the downward biasing force against the valve plug 226 is removed, allowing the screw gland 228 to be removed with a relatively lower amount of force, for example by hand. To allow for emergency redundancy, the screw gland 228 may still include one or two hole sets 230 designed to accommodate a steel bar to manually remove the screw gland 228 where hydraulic operation is not available or possible (e.g., where a hydraulic pump is not available or an unexpected failure occurs).

With the screw gland 228 removed, the valve plug 226 may also be removed through the hollow center of the threaded ring 222. After the valve plug 226 is removed, the valve service 208 becomes accessible (e.g., for maintenance, removal, etc.). After any desired operations are performed, the valve plug 226 may be replaced and then the screw gland re-threaded (by hand, for example) all while the pressures is still being applied against the piston 218 in the recess 220. Although described as by hand, the screw gland 228 may alternatively be inserted or removed by some other simple tool that does not require more torque than can be produced by simple human movement (e.g., no need for power tools).

Once the screw gland 228 is in a desired position, the hydraulic pump may vacate the fluid currently applying pressure against the piston 218 in the recess 220, which reduced the upward force on the threaded ring 222 until it is overcome by the downward biasing force of the compressed springs 216. The threaded ring 222 moves downward along the holes 232*a* until the threaded ring 222 and the screw gland 228 are again pressed against the fluid discharge module 202 and the valve plug 226, respectively. The downward biasing force of the springs 216 is sufficient to ensure a constant force applied against the valve plug 226 during high pressure operation of the mud pump 180, ensuring a fluid tight seal.

Figure 5A:
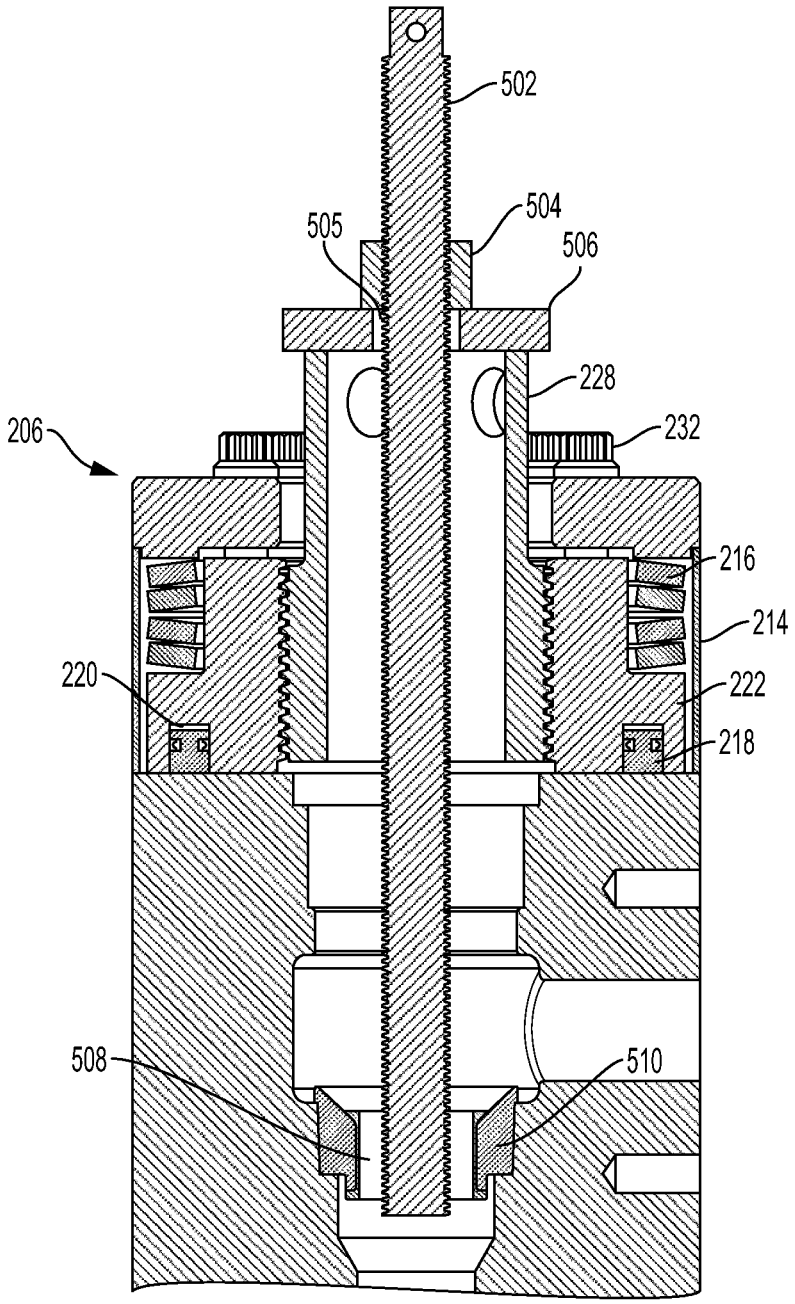
FIG. 5A is a schematic of a cross-sectional view of an exemplary valve cover assembly with puller rod assembly according to one or more aspects of the present disclosure.
Figure 5B:
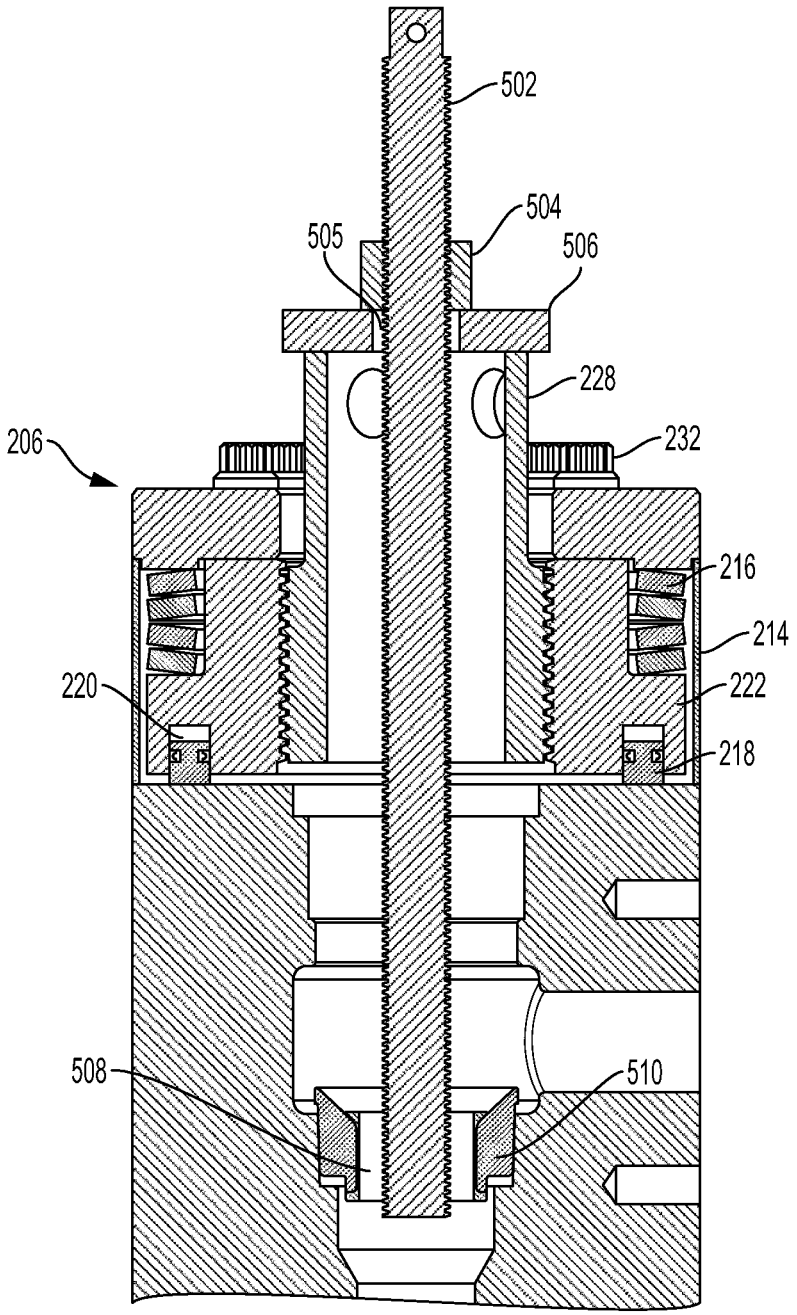
FIG. 5B is a schematic of a cross-sectional view of an exemplary valve cover assembly with puller rod assembly according to one or more aspects of the present disclosure.

In addition to assisting with the insertion/removal of screw glands, embodiments of the present disclosure may further be used to remove the valve seat of the valve service 208. This is illustrated in FIGS. 5A and 5B. FIG. 5A is a schematic of a cross-sectional view of an exemplary valve cover assembly 206 with puller rod assembly according to one or more aspects of the present disclosure. Valve seat removal may be available, for example, after the screw gland 228 and valve plug 226 has been removed according to the embodiments discussed above with respect to FIGS. 2, 3A, 3B, 3C, and 3D, and the piston 218 has been de-actuated to the first position (e.g., by the hydraulic pump releasing the fluid previously pumped into the recess 220).

The puller rod assembly includes puller rod 502, head nut 504, retainer plate 506, and puller head 508. The puller rod 502 includes a proximal end and a distal end. The puller head 508 is situated at or near the distal end of the puller rod 502. The puller head 508 includes multiple surfaces that are designed to engage and grip (e.g., lock into) the valve seat 510. With the screw gland 228, valve plug 226, and valve and spring of valve service 208 removed, the puller rod 502 with puller head 508 may be inserted into the bore opening 225 and, more generally, the fluid passage bore 212 until the puller head 508 comes into contact with sides of the valve seat 510.

At the proximal end of the puller rod 502, the puller rod 502 is connected with the retainer plate 506 by way of the head nut 504. The retainer plate 506 includes an inner diameter defining a hollow center 505, through which the puller rod 502 extends. In an embodiment, the puller rod 502 may be threaded so as to receive the head nut 504 at variable positions along the length of the puller rod 502. The head nut 504 is threaded on the puller rod 502 until the head nut comes in contact with an upper surface of the retainer plate 506, indicating that the puller rod assembly is in place.

With the puller rod assembly of FIG. 5A in place and the piston 218 of the valve cover assembly 206 in place, the piston 218 may now be actuated as described above with respect to FIGS. 4A and 4B. As the piston 218 is actuated through the application of hydraulic force into the recess 220 of the threaded ring 222, the threaded ring 222 is raised which, in turn, raises the screw gland 228. As the screw gland 228 moves upward, the upward force (e.g., force 403) is applied from the screw gland 228 to the retainer plate 506. This in turn applies an upward force to the puller rod 502, puller head 508, and valve seat 510. Hydraulic pressure is applied to the recess 220 against the piston 218 until the upward force 403 overcomes the shrink fit/friction fit of the valve seat 226 in the bore opening 225. When that force is overcome, the puller rod 502 dislodges the valve seat 510 and pulls it from the fluid end discharge module. This is illustrated in FIG. 5B, which shows the puller rod assembly in an actuated position. Aspects of the present disclosure therefore remove the need for installing a hydraulic jack on top of the existing valve cover assembly to enable the puller rod 502 to dislodge the valve seat 510, as conventionally required.

Figure 6A:
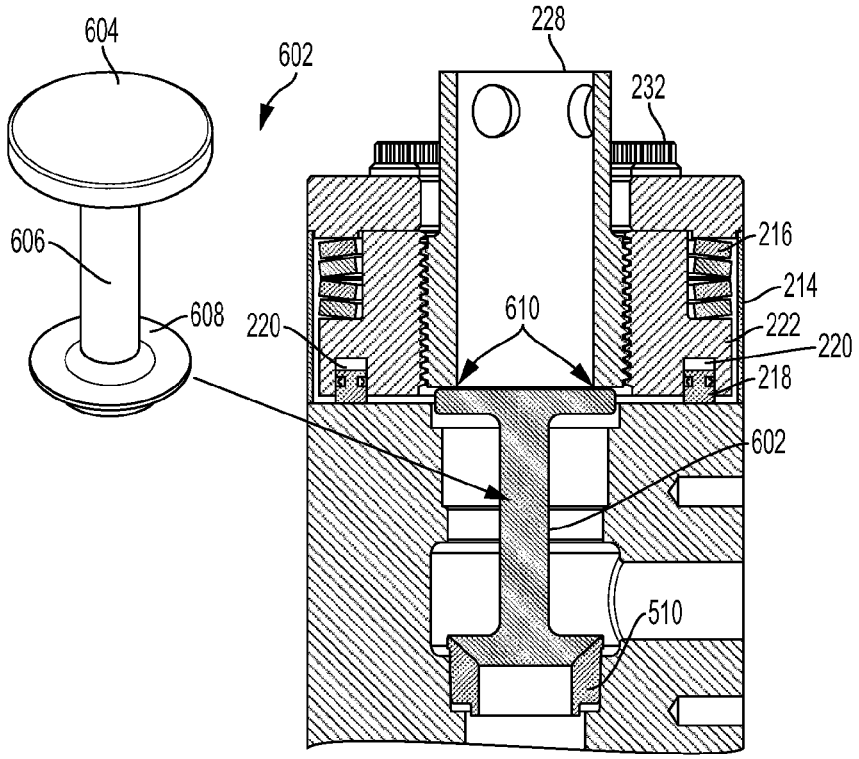
FIG. 6A is a schematic of a cross-sectional view of an exemplary valve cover assembly with valve seat driver according to one or more aspects of the present disclosure.
Figure 6B:
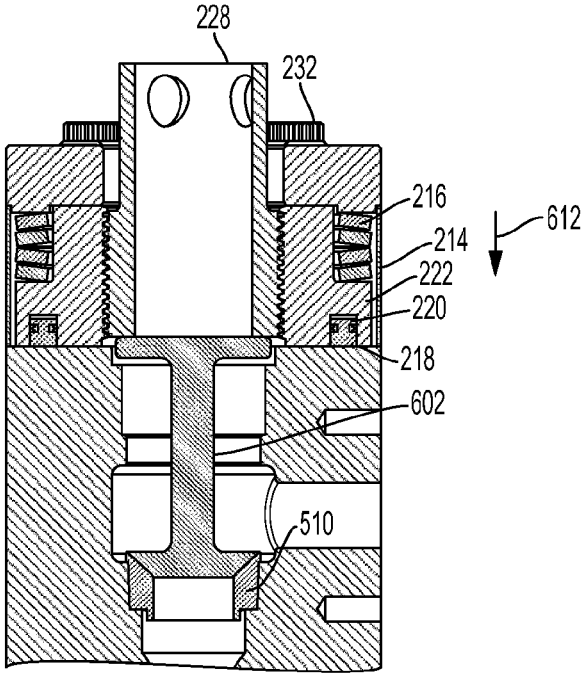
FIG. 6B is a schematic of a cross-sectional view of an exemplary valve cover assembly with valve seat driver according to one or more aspects of the present disclosure.

In addition to assisting with dislodging valve seats, embodiments of the present disclosure may further be used to install the valve seat 510 during servicing. This is illustrated in FIGS. 6A and 6B. FIG. 6A is a schematic of a cross-sectional view of an exemplary valve cover assembly with valve seat driver according to one or more aspects of the present disclosure. This may be done, for example, after the removal operations described above with respect to FIGS. 5A and 5B. According to the embodiment of FIG. 6A, installation of a valve seat 510 may begin with the piston 218 actuated (and, therefore, the threaded ring 222 and screw gland 228 raised).

The screw gland 228 is removed to allow a new valve seat 510 to be installed (e.g., placed in by hand) as well as to permit the temporary insertion of a valve seat driver tool 602 above the new valve seat 510 in the bore. The valve seat driver tool 602 may include a proximal contact end 604, a shaft 606, and a distal contact end 608. The proximal contact end 604 may be a solid disk with a diameter that is less than the diameter of the bore opening 225. In an embodiment, the bore opening 225 may have gradually decreasing diameter extending into the fluid discharge module 202, and the diameter of the proximal contact end 604 may be less than an initial diameter of the bore opening 225 but greater than a next stage of the bore opening 225, such that the proximal contact end 604 may stop the valve seat driver tool 602 from extending too far into the fluid discharge module 202.

The valve seat driver tool 602 may further include the shaft 606. In an embodiment, the shaft 606 may be an elongated shaft that has a smaller diameter than the proximal contact end 604, for example substantially smaller, so as to reduce the amount of material required for the valve seat driver tool 602. The shaft 606 extends from the proximal contact end 604 to the distal contact end 608. The distal contact end 608 may have a tapered diameter as it extends distally. This tapering may be sized to coincide with the shape of the valve seat 510 and the tapering that occurs in the fluid passage bore 212 just beyond the bore opening 225. With the valve seat driver tool 602 in place, the screw gland 228 is re-threaded in the threaded ring 222 while the piston 218 is still actuated. Once the screw gland 228 is in place, the hydraulic pressure in the recess 220 is released and the piston 218 is de-actuated. Releasing the hydraulic pressure, and the resulting de-actuating of the piston 218, allows the springs 216 to apply a downward force 612 to force the valve seat driver tool 602 down as well, as illustrated in FIG. 6B. This presses the valve seat 510 into the tapered portion of the fluid passage bore 212 and into a desired position.

After the valve seat 510 is pressed into place, the piston 218 may be actuated again to allow for easy removal of the screw gland 228, installation of the rest of the valve service 208, placement of the valve plug 226 in the bore opening 225, and re-installation of the screw gland 228. The threaded ring may then again be de-actuated to maintain sealing force against the valve plug 226.

Figure 7:
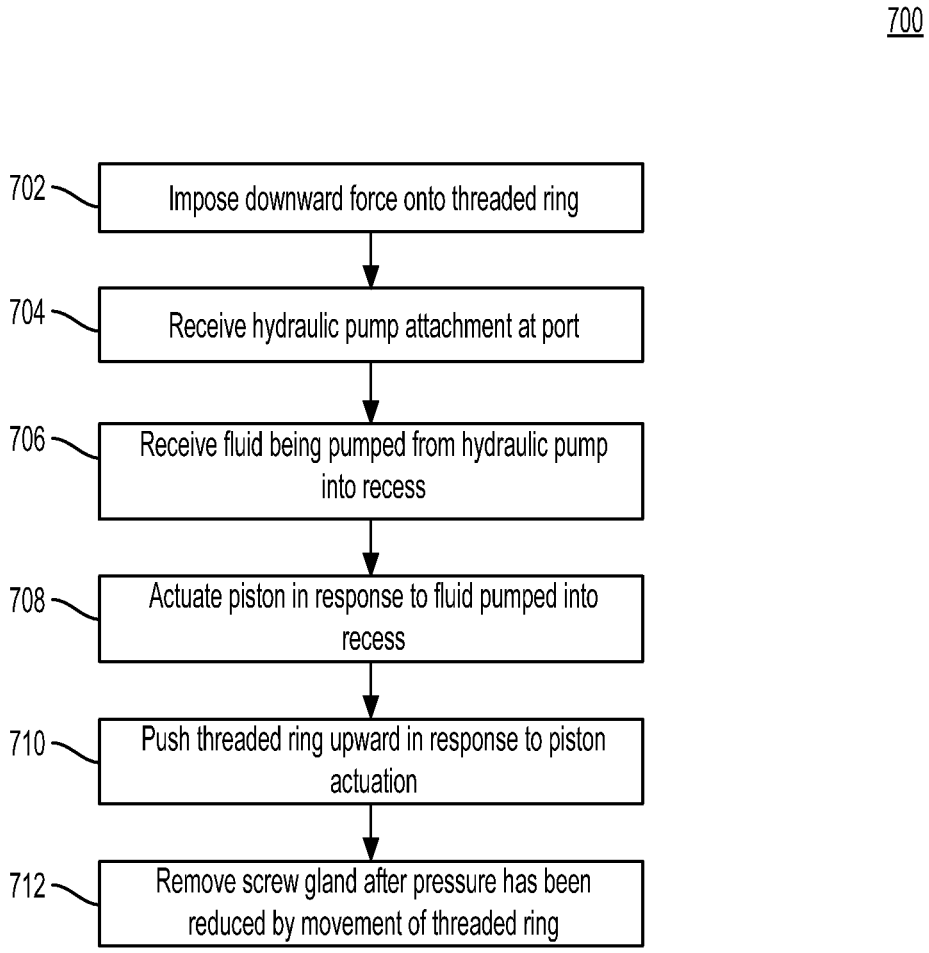
FIG. 7 is an exemplary flow chart showing an exemplary process for removing a screw gland according to aspects of the present disclosure.

FIG. 7 is a flow chart showing an exemplary process 700 for removing a screw gland according to aspects of the present disclosure. The process 700 may be performed, for example, with respect to the exemplary valve seat assembly 206 that is coupled to a fluid end 200 (either fluid discharge module 202 or fluid intake module 204) discussed above with respect to FIGS. 2 and 3A-3D.

At block 702, the springs 216 impose a downward biasing force on the threaded ring, for example the threaded ring interface of the threaded ring 222. This downward force is translated from the threaded ring 222 to the screw gland 228 as well, which keeps a valve plug 226 in place in the bore opening 225 during operation.

At block 704, a hydraulic pump is attached to the valve seat assembly 206, for example at port 224.

At block 706, after the hydraulic pump is attached to the port 224, the recess 220 receives fluid being pumped from the hydraulic pump.

In response to the added pressure from the incoming fluid, at block 708 a piston is actuated, for example piston 218. For example, actuation of the piston 218 may include pressing the piston against the top of the fluid end module.

In response, at block 710 the threaded ring 222, in which the recess 220 is located, is pushed upward from the pressing of the piston 218 against the block of the fluid end and the increased pressure in the recess 220. This occurs in response to the force from the pressure reaching an amount greater than the downward biasing force from the springs 216.

At block 712, after the threaded ring 222 has finished moving (e.g., by either ceasing from adding additional fluid with the pump into the recess 220 or by the threaded ring 222 contacting the bottom surface of the top end 223), the screw gland 228 may be removed with a relatively lower amount of force, such as by hand, as a result of the reduced amount of force on the screw gland 228.

Figure 8:
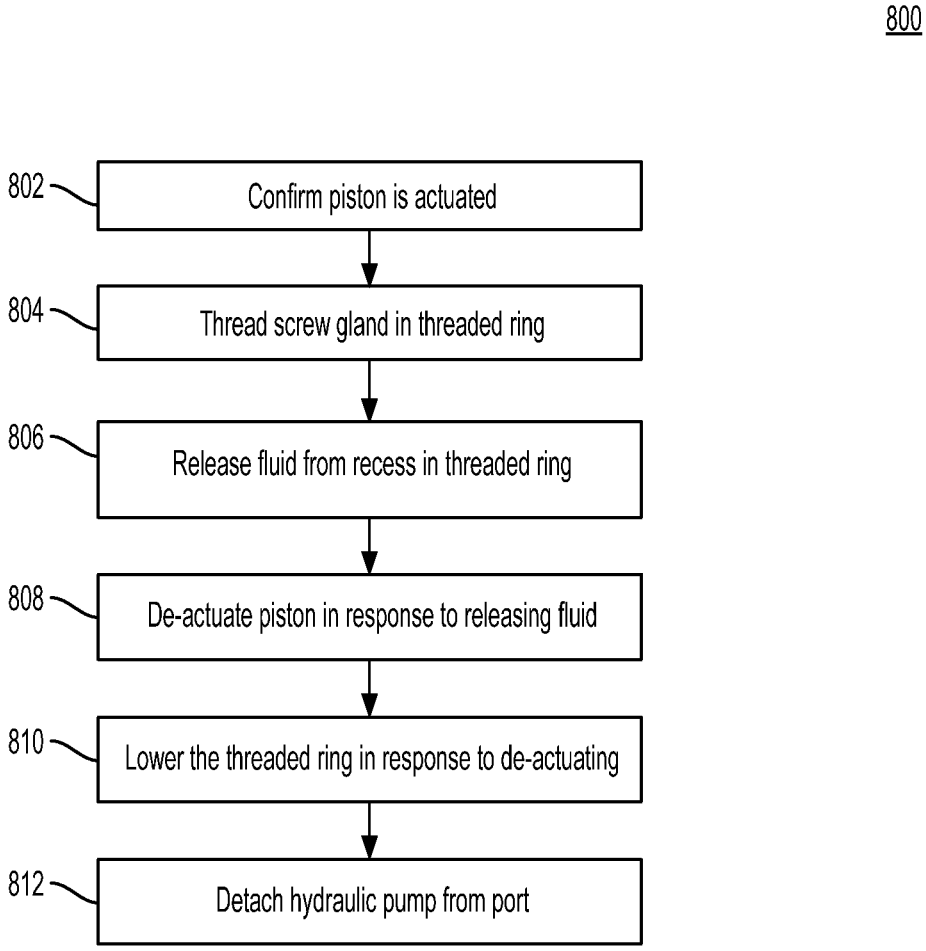
FIG. 8 is an exemplary flow chart showing an exemplary process for installing a screw gland according to aspects of the present disclosure.

FIG. 8 is an exemplary flow chart showing an exemplary process 800 for installing a screw gland according to aspects of the present disclosure. For example, the process 800 may occur after the process 700. In between the conclusion of block 712 of process 700 and block 802 of FIG. 8, one or more elements of a valve service may be removed/installed or other maintenance performed.

At block 802, it is confirmed that the hydraulic pump is still attached to the valve cover assembly 206 and, as a result, that the piston 218 is still actuated. It may also be confirmed that the valve plug 226 is in place.

At block 804, the screw gland 228 may be threaded with the threaded ring 222. In some implementations, threading may be done by hand, for example as a result of the reduced amount of force on the screw gland 228 while the threaded ring 222 is lifted by the piston 218.

At block 806, the fluid is released from the recess 220 by the hydraulic pump. As a result, the pressure applied against the piston 218 reduces.

At block 808, the piston 218 is de-actuated as the pressure reduces until the force is less than the downward biasing force of the springs 216.

At block 810, as a result of the de-actuating of the piston 218, the threaded ring 222 with the screw gland 228 is lowered toward the upper surface of the fluid end module. This continues until the screw gland 228 is in place and pressing against the valve plug 226 and the threaded ring 222 is lowered toward the surface of the fluid end module.

At block 812, with the pressure in the recess 220 released, the hydraulic pump may be detached from the port 224.

Figure 9:
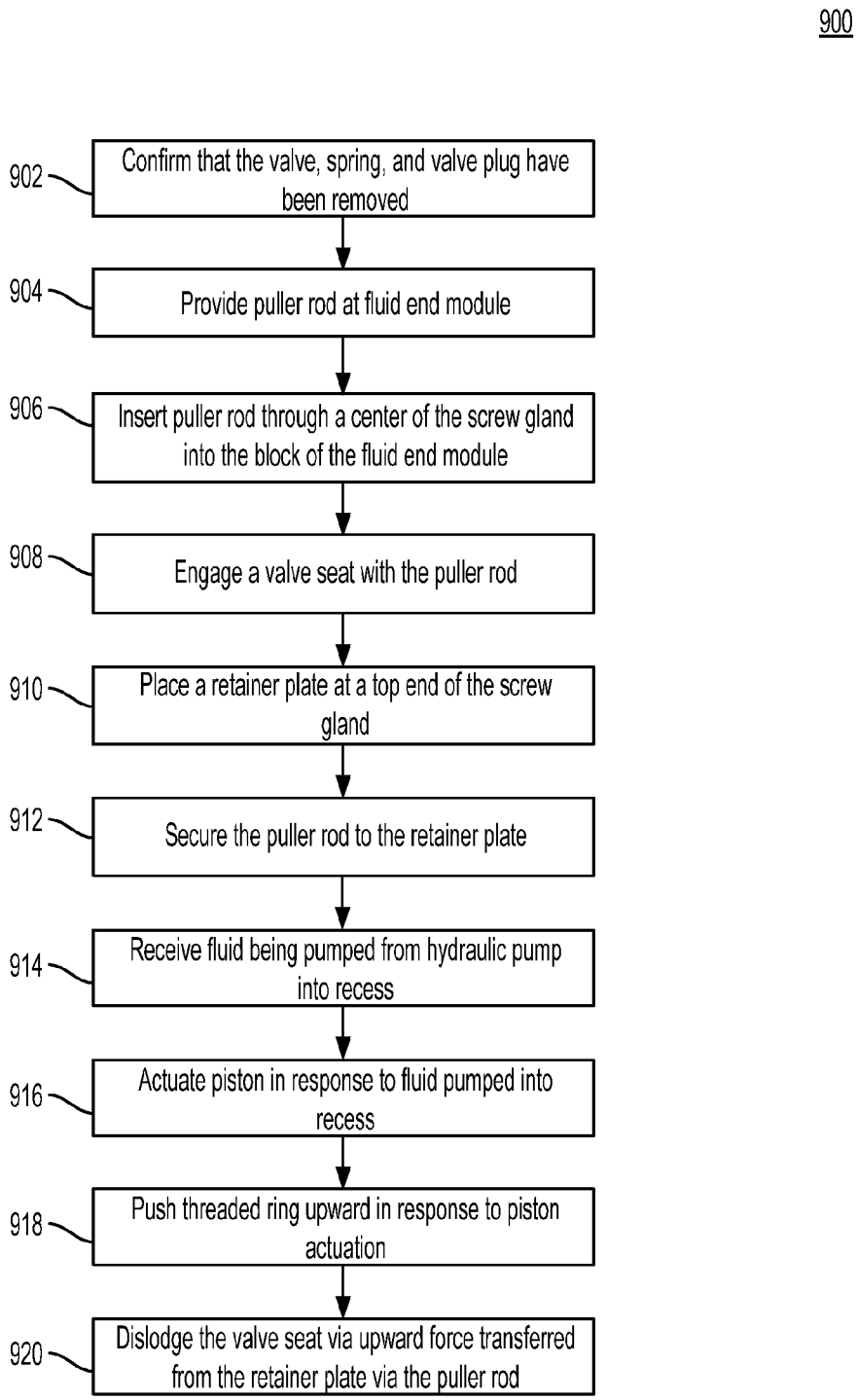
FIG. 9 is an exemplary flow chart showing an exemplary process for pulling a valve seat according to aspects of the present disclosure.

FIG. 9 is an exemplary flow chart showing an exemplary process 900 for pulling a valve seat according to aspects of the present disclosure. According to embodiments of FIG. 9, prior to block 902 the screw gland 228 may have been removed, for example according to FIG. 7, the valve plug 226 removed, the valve and spring from valve service 208 removed, and the screw gland 228 replaced and the threaded ring 222 and screw gland 228 lowered for example according to FIG. 8.

At block 902, it is confirmed that the valve and spring from valve service 208 and the valve plug 226 have been removed.

At block 904, a puller rod 502 is provided at the bore of the fluid end module.

At block 906, the puller rod 502 is inserted through the center of the screw gland 228 in a direction into the block of the fluid end module. The puller rod 502 continues to be inserted until the puller head 508 of the puller rod 502 engages with the valve seat 510, which occurs at block 908.

At block 910, a retainer plate 506 is placed at a top end of the screw gland 228. This may be placed on top of the screw gland 228 before or after the puller rod 502 is inserted into the fluid end module through the screw gland 228.

At block 912, the puller rod 502 is secured to the retainer plate 506 with a head nut 504. For example, the puller rod 502 may have a thread and be threadably engaged with the head nut 504. The head nut 504 may be tightened until the head nut 504 is secure against the retainer plate on the puller rod 502.

At block 914, the recess 220 receives fluid being pumped from the hydraulic pump that is either attached to the port 224 as part of this step or was already previously attached to the port 224.

At block 916, in response to the added pressure from the incoming fluid, piston 218 is actuated, which may include pressing the piston against the top of the fluid end module in response to the added pressure from the added fluid.

In response, at block 918 the threaded ring 222, in which the recess 220 is located, is pushed upward from the pressing of the piston 218 against the block of the fluid end and the increased pressure in the recess 220. This occurs in response to the force from the pressure reaching an amount greater than the downward biasing force from the springs 216. Since the screw gland 228 is threadably engaged with the threaded ring 222, as the threaded ring 222 lifts the screw gland 228 and the retainer plate 506 are pushed upward as well.

At block 920, as the threaded ring 222/screw gland 228 push the retainer plate 506 upward, the force is transferred from the retainer plate 506 to the valve seat 510 via the pull rod 502. As a result, the puller rod 502 dislodges the valve seat 510 and pulls it from the fluid end discharge module.

Figure 10:
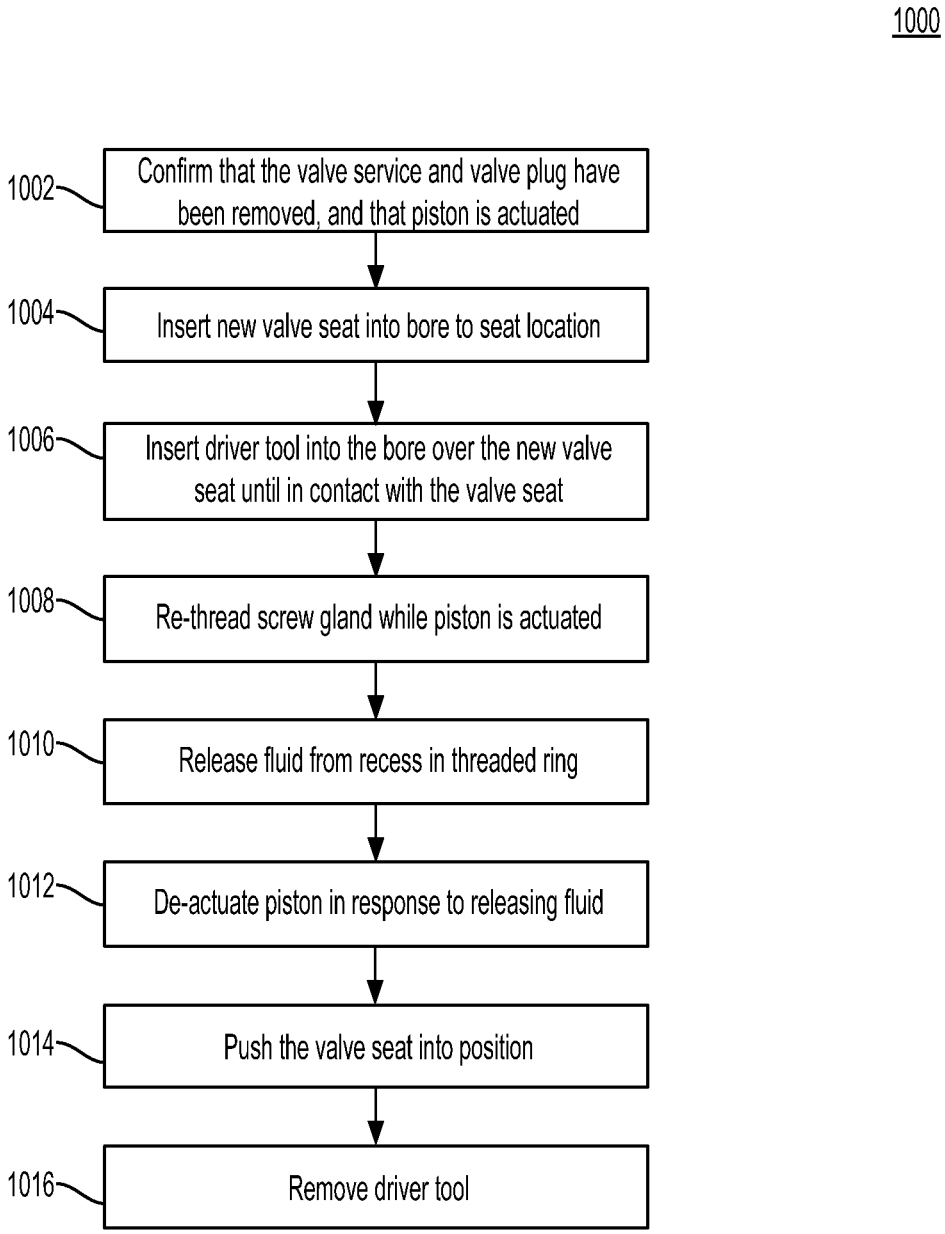
FIG. 10 is an exemplary flowchart of a process for installing a valve seat according to one or more aspects of the present disclosure.

FIG. 10 is an exemplary flowchart of a process 1000 for installing a valve seat according to one or more aspects of the present disclosure. According to embodiments of FIG. 10, prior to block 1002 the screw gland 228 may have been removed, for example according to FIG. 7, the valve plug 226 removed, and the valve service 208 removed while the screw gland 228 is still removed while the threaded ring 222 is raised (from the piston 218 being actuated still).

At block 1002, it is confirmed that the valve service 208, the valve plug 226, and the screw gland 228 have been removed, and that the piston 218 is still actuated.

At block 1004, a new valve seat 510 is inserted into the fluid passageway bore 212 until it makes soft contact with the desired seat location.

At block 1006, a driver tool 602 is inserted into the bore over the new valve seat 510 until the distal contact end 608 engages the new valve seat 510.

At block 1008, the screw gland 228 is rethreaded into the threaded ring 222 while the piston 218 is still actuated. The screw gland 228 is rethreaded, for example, until it makes contact with the proximal contact end 604 of the driver tool 602.

At block 1010, the fluid in the recess 220 is released by the hydraulic pump still attached to the port 224. As a result, the pressure applied against the piston 218 reduces.

At block 1012, the piston 218 is de-actuated as the pressure reduces until the force is less than the downward biasing force of the springs 216.

At block 1014, as a result of the de-actuating of the piston 218, the threaded ring 222 with the screw gland 228 is lowered toward the upper surface of the fluid end module, which causes the screw gland 228 to push the driver tool 602 downward as well. This continues until the screw gland 228 pushes the new valve seat 510 into the desired position.

At block 1016, with the pressure in the recess 220 released, the hydraulic pump may be detached from the port 224.

Although the methods of FIGS. 7, 8, 9, and 10 have been generally described independently from each other, it will be recognized that the different methods, as well as elements of the different methods, may be combined with each other in various iterations without departing from the scope of the present disclosure.

In view of all of the above and the figures, one of ordinary skill in the art will readily recognize that the present disclosure introduces a mud pump fluid end valve cover assembly, comprising: a threaded ring attachable to a fluid end module and configured to receive a screw gland; an outside housing surrounding the threaded ring and providing an offset between the fluid end module and a top end portion of the fluid end valve cover; a spring positioned between the top end portion and the threaded ring and biased to provide a downward biasing force on the threaded ring toward the fluid end module, wherein the screw gland in the threaded ring translates the downward biasing force to a reaction force applied against a valve plug of the fluid end module; and a piston positioned at a base of the threaded ring and configured to actuate to overcome the downward biasing force and lift the threaded ring from the fluid end module to reduce the reaction force of the screw gland against the valve plug.

The mud pump fluid end valve cover assembly may include wherein the piston comprises an annular piston. The mud pump fluid end valve cover assembly may also include a fitting configured to couple a hydraulic pump to a hydraulic circuit associated with the piston, wherein the piston is configured to actuate in response to the hydraulic pump pumping fluid into the hydraulic circuit, and wherein the piston is configured to de-actuate in response to the hydraulic pump releasing the pumping fluid from the hydraulic circuit. The mud pump fluid end valve cover assembly may also include wherein the threaded ring with the screw gland is further configured to apply loading on the valve plug to hold the valve plug in place in response to the downward biasing force from the spring as the piston is de-actuated. The mud pump fluid end valve cover assembly may also include a retainer plate configured to be secured in place on a top surface of the screw gland while the piston is in a de-actuated state; and a puller rod comprising a proximate end and a distal end comprising a puller head, the puller head being configured to engage a valve seat and the proximate end being configured to be secured to the retainer plate, wherein, in response to actuation of the piston, upward force is imparted via the screw gland in the threaded ring to the retainer plate to lift the retainer plate, and wherein the puller rod translates the lifting force on the retainer plate to dislodge the valve seat from the fluid end module. The mud pump fluid end valve cover assembly may also include a driver tool comprising an elongated shaft extending into a bore of the fluid end module, a proximal end of the elongated shaft configured to engage with the screw gland in the threaded ring, and a distal end of the elongated shaft is configured to engage with a valve seat in the fluid end module. The mud pump fluid end valve cover assembly may also include wherein the driver tool is insertable into the bore while the piston is actuated and the screw gland is removed from the threaded ring, the screw gland being associated with the threaded ring so that a base of the screw gland comes into contact with the proximal end of the elongated shaft while the piston is actuated, and the piston is de-actuatable to allow the downward biasing force to push the distal end of the elongated shaft against the valve seat until the valve seat is pressed into a desired position, the downward biasing force being passed to the distal end via the elongated shaft and the proximal end in contact with the screw gland in the threaded ring.

The present disclosure also includes a method, comprising: imposing, by a spring, a downward biasing force against a top end portion of a threaded ring that is coupled to a fluid end module; actuating a piston positioned between a bottom end of the threaded ring and the fluid end module, wherein the actuating the piston overcomes the downward biasing force and lifts the threaded ring from the fluid end module to reduce the downward biasing force of a screw gland in the threaded ring against a valve plug of the fluid end module; and de-threading the screw gland from the threaded ring while the downward biasing force is reduced.

The method may include lowering the screw gland, while the screw gland is threaded in the threaded ring, toward the fluid end module in response to de-actuating the piston and in response to the imposed downward biasing force by the spring. The method may also include inserting, while the valve plug is removed, a puller rod into a bore of the fluid end module through the screw gland until a puller head of the puller rod engages a valve seat in the bore; securing the puller rod in place on a top surface of the screw gland with a retainer plate while the piston is de-actuated; actuating the piston to raise the threaded ring, screw gland, retainer plate, and the puller rod; and dislodging the valve seat from the fluid end module in response to the actuating. The method may also include removing the dislodged valve seat; and placing a new valve seat into the bore. The method may also include inserting a driver tool into the bore until a distal end of the driver tool engages with the new valve seat in the bore; re-threading the screw gland in the threaded ring while the piston is actuated, the re-threaded screw gland being in contact with a proximal end of the driver tool; de-actuating the piston to lower the screw gland against the proximal end; and pressing the new valve seat into a desired position in response to force conveyed from the re-threaded screw gland to the valve seat via the driver tool. The method may also include wherein the threaded ring comprises a hydraulic circuit associated with the piston, the method further comprising coupling a hydraulic pump to a fitting associated with the hydraulic circuit; receiving hydraulic fluid in the hydraulic circuit from the coupled hydraulic pump; and actuating the piston in response to receiving the hydraulic fluid. The method may also include releasing the pumping fluid from the hydraulic circuit; and de-actuating the piston in response to the releasing the hydraulic fluid.

The present method also introduces a method, comprising: providing a puller rod insertable into a bore of a fluid end module through a screw gland in a threaded ring coupled to the fluid end module until a puller head of the puller rod engages a valve seat in the bore; securing the puller rod in place on a top surface of the screw gland with a retainer plate while a piston positioned between a bottom end of the threaded ring and the fluid end module is de-actuated; actuating the piston to raise the threaded ring, screw gland, retainer plate, and the puller rod to overcome a downward biasing force imposed on the threaded ring by a spring; and dislodging the valve seat from the fluid end module in response to the actuating.

The method may include removing the dislodged valve seat; and placing a new valve seat into the bore. The method may also include inserting a driver tool into the bore until a distal end of the driver tool engages with the new valve seat in the bore; and re-threading the screw gland in the threaded ring while the piston is actuated, the re-threaded screw gland being in contact with a proximal end of the driver tool. The method may also include de-actuating the piston to lower the screw gland against the proximal end; and pressing the new valve seat into a desired position in response to force conveyed from the re-threaded screw gland to the valve seat via the driver tool. The method may also include wherein a new valve seat is placed and a valve plug inserted into an entry area of the bore, the method further comprising lowering the screw gland in the threaded ring toward the valve plug in the fluid end module in response to de-actuating the piston and the imposed downward biasing force by the spring; and maintaining the valve plug in place based on the downward biasing force applied via the screw gland on the valve plug. The method may also include actuating the piston to overcomes the downward biasing force and lift the threaded ring from the fluid end module to reduce the downward biasing force of the screw gland against the valve plug; and de-threading the screw gland from the threaded ring while the downward biasing force is reduced.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A mud pump fluid end valve cover assembly, comprising:

a threaded ring attachable to a fluid end module and configured to receive a screw gland;

an outside housing surrounding the threaded ring and providing an offset between the fluid end module and a top end portion of the fluid end valve cover;

a spring positioned between the top end portion and the threaded ring and biased to provide a downward biasing force on the threaded ring toward the fluid end module, wherein the screw gland in the threaded ring translates the downward biasing force to a reaction force applied against a valve plug of the fluid end module; and a piston positioned at a base of the threaded ring and configured to actuate to overcome the downward biasing force and lift the threaded ring from the fluid end module to reduce the reaction force of the screw gland against the valve plug.

2. The mud pump fluid end valve cover assembly of claim 1, wherein the piston comprises an annular piston.

3. The mud pump fluid end valve cover assembly of claim 1, further comprising:

a fitting configured to couple a hydraulic pump to a hydraulic circuit associated with the piston, wherein the piston is configured to actuate in response to the hydraulic pump pumping fluid into the hydraulic circuit, and wherein the piston is configured to de-actuate in response to the hydraulic pump releasing the pumping fluid from the hydraulic circuit.

4. The mud pump fluid end valve cover assembly of claim 1, wherein the threaded ring with the screw gland is further configured to apply loading on the valve plug to hold the valve plug in place in response to the downward biasing force from the spring as the piston is de-actuated.

5. The mud pump fluid end valve cover assembly of claim 1, further comprising:

a retainer plate configured to be secured in place on a top surface of the screw gland while the piston is in a de-actuated state; and a puller rod comprising a proximate end and a distal end comprising a puller head, the puller head being configured to engage a valve seat and the proximate end being configured to be secured to the retainer plate, wherein, in response to actuation of the piston, upward force is imparted via the screw gland in the threaded ring to the retainer plate to lift the retainer plate, and wherein the puller rod translates the upward force on the retainer plate to dislodge the valve seat from the fluid end module.

6. The mud pump fluid end valve cover assembly of claim 1, further comprising:

a driver tool comprising an elongated shaft extending into a bore of the fluid end module, a proximal end of the elongated shaft configured to engage with the screw gland in the threaded ring, and a distal end of the elongated shaft is configured to engage with a valve seat in the fluid end module.

7. The mud pump fluid end valve cover assembly of claim 6, wherein:

the driver tool is insertable into the bore while the piston is actuated and the screw gland is removed from the threaded ring, the screw gland being associated with the threaded ring so that a base of the screw gland comes into contact with the proximal end of the elongated shaft while the piston is actuated, and the piston is de-actuatable to allow the downward biasing force to push the distal end of the elongated shaft against the valve seat until the valve seat is pressed into a desired position, the downward biasing force being passed to the distal end via the elongated shaft and the proximal end in contact with the screw gland in the threaded ring.

8. A mud pump, comprising:

a fluid end module comprising a fluid passage bore extending through the fluid end module; and a valve cover assembly attachable to the fluid end module, the valve cover assembly comprising:

a threaded ring attachable to the fluid end module and configured to receive a screw gland;

an outside housing surrounding the threaded ring and providing an offset between the fluid end module and a top end portion of the valve cover assembly, wherein the outside housing has a length along a vertical axis of the valve cover assembly that is larger than a length of the threaded ring along the vertical axis, the vertical axis being substantially parallel to the fluid passage bore;

a spring positioned between the top end portion and the threaded ring and biased to provide a downward biasing force on the threaded ring toward the fluid end module, wherein the screw gland in the threaded ring translates the downward biasing force to a reaction force applied against a valve plug of the fluid end module; and a piston positioned at a base of the threaded ring and configured to actuate to overcome the downward biasing force and lift the threaded ring from the fluid end module to reduce the reaction force of the screw gland against the valve plug.

9. The mud pump of claim 8, wherein the piston comprises an annular piston.

10. The mud pump of claim 8, further comprising a fitting configured to couple a hydraulic pump to a hydraulic circuit associated with the piston.

11. The mud pump of claim 10, wherein:

the piston is configured to actuate in response to the hydraulic pump pumping fluid into the hydraulic circuit, and the piston is configured to de-actuate in response to the hydraulic pump releasing the pumping fluid from the hydraulic circuit.

12. The mud pump of claim 8, wherein the threaded ring with the screw gland is further configured to apply loading on the valve plug to hold the valve plug in place in response to the downward biasing force from the spring as the piston is de-actuated.

13. The mud pump of claim 8, wherein:

the valve cover assembly further comprises a retainer plate configured to be secured in place on a top surface of the screw gland while the piston is in a de-actuated state, the fluid end module comprises a bore configured to receive a valve seat, the valve seat configured to engage with a puller head of a puller rod, a distal end of the puller rod comprises the puller head, and a proximate end of the puller rod is configured to be secured to the retainer plate.

14. The mud pump of claim 13, wherein:

upward force is imparted to the retainer plate, in response to actuation of the piston, via the screw gland in the threaded ring to lift the retainer plate, and the valve seat is dislodged from the fluid end module in response to the puller rod translating the upward force on the retainer plate.

15. The mud pump of claim 8, wherein:

the fluid end module comprises a bore configured to receive a driver tool, the driver tool comprising an elongated shaft, a proximal end of the elongated shaft is configured to engage with the screw gland in the threaded ring, and a distal end of the elongated shaft is configured to engage with a valve seat.

16. The mud pump of claim 15, wherein:

the driver tool is insertable into the bore while the piston is actuated and the screw gland is removed from the threaded ring, the screw gland is associated with the threaded ring so that a base of the screw gland comes into contact with the proximal end of the elongated shaft while the piston is actuated, and the piston is de-actuatable to allow the downward biasing force to push the distal end of the elongated shaft against the valve seat until the valve seat is pressed into a desired position, the downward biasing force being passed to the distal end via the elongated shaft and the proximal end in contact with the screw gland in the threaded ring.

17. The mud pump of claim 8, wherein:

the base of the threaded ring comprises a plurality of recesses, and the piston comprises a plurality of pistons positioned in respective recesses of the plurality of recesses at the base of the threaded ring.

18. The mud pump of claim 8, wherein the threaded ring comprises:

a base portion; and an upper portion, wherein a diameter of the base portion is larger than a diameter of the upper portion.

* * * * *